US010292555B2

(12) United States Patent
Prosser

(10) Patent No.: US 10,292,555 B2
(45) Date of Patent: May 21, 2019

(54) FLOOR TOOL FOR A VACUUM CLEANER

(71) Applicant: Dyson Technology Limited, Wiltshire (GB)

(72) Inventor: Glenn Colin Prosser, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 666 days.

(21) Appl. No.: 14/943,862

(22) Filed: Nov. 17, 2015

(65) Prior Publication Data

US 2016/0150927 A1 Jun. 2, 2016

(30) Foreign Application Priority Data

Dec. 2, 2014 (GB) ..... 1421418.3

(51) Int. Cl.

| | |
|---|---|
| ***A47L 9/00*** | (2006.01) |
| ***A47L 9/02*** | (2006.01) |
| ***A47L 9/24*** | (2006.01) |

(52) U.S. Cl.

CPC ..... *A47L 9/02* (2013.01); *A47L 9/00* (2013.01); *A47L 9/248* (2013.01)

(58) Field of Classification Search

CPC ..... A47L 9/00; A47L 9/04; A47L 9/24
See application file for complete search history.

(56) References Cited

U.S. PATENT DOCUMENTS

| | | | | |
|---|---|---|---|---|
| 4,336,628 A * | 6/1982 | Bradshaw | ..... | A47L 9/02 15/415.1 |
| 8,869,349 B2 * | 10/2014 | Henderson | ..... | A47L 5/28 15/411 |
| 2001/0037536 A1 * | 11/2001 | Kim | ..... | A47L 9/02 15/361 |
| 2006/0137134 A1 * | 6/2006 | Dilger | ..... | A47L 9/02 15/415.1 |

(Continued)

FOREIGN PATENT DOCUMENTS

| | | | | |
|---|---|---|---|---|
| EP | 1031312 A1 * | 8/2000 | ..... | A47L 9/02 |
| EP | 1 674 012 | 6/2006 | | |

(Continued)

OTHER PUBLICATIONS

International Search Report and Written Opinion dated Dec. 9, 2015, directed towards International Application No. PCT/GB2015/052711; 11 pages.

(Continued)

*Primary Examiner* — Michael D Jennings
(74) *Attorney, Agent, or Firm* — Morrison & Foerster LLP

(57) ABSTRACT

A floor tool for a cleaning appliance, the floor tool comprising a cleaner head and a duct assembly. The cleaner head has a suction inlet through which dirt-laden fluid is drawn into the cleaner head and an outlet through which the fluid is discharged. The duct assembly carries the fluid from the outlet to a wand connectable to the duct assembly and comprises a front conduit and a rear conduit. The front (Continued)

conduit is connected to the cleaner head for rotation about a first axis. The rear conduit is connectable to the wand and is rotatable relative to the front conduit about a second axis perpendicular to the first axis. When the floor tool is resting on the floor and the rear conduit extends upwardly, the front and rear conduits arc around and over the second axis.

18 Claims, 4 Drawing Sheets

(56) References Cited

U.S. PATENT DOCUMENTS

| | | | |
|---|---|---|---|
| 2011/0010886 | A1 | 1/2011 | Arthey et al. |
| 2016/0324382 | A1 | 11/2016 | Van Wolferen et al. |

FOREIGN PATENT DOCUMENTS

| | | |
|---|---|---|
| EP | 1875846 | 1/2008 |
| EP | 1967114 | 9/2008 |
| EP | 2064978 | 6/2009 |
| EP | 2815685 | 12/2014 |
| GB | 2470920 | 12/2010 |
| GB | 2471920 | 1/2011 |
| GB | 2488368 | 8/2012 |
| JP | 11-56721 | 3/1999 |
| JP | 11-155786 | 6/1999 |
| JP | 11-187993 | 7/1999 |
| JP | 11-206635 | 8/1999 |
| JP | 11-206637 | 8/1999 |
| JP | 11-206645 | 8/1999 |
| JP | 11-206654 | 8/1999 |
| JP | 2000-83879 | 3/2000 |
| JP | 2000-93367 | 4/2000 |
| JP | 2000-107105 | 4/2000 |
| JP | 2000-107106 | 4/2000 |
| JP | 2000-217755 | 8/2000 |
| JP | 2001-128905 | 5/2001 |
| JP | 2001-128909 | 5/2001 |
| JP | 2001-149281 | 6/2001 |
| JP | 2001-149282 | 6/2001 |
| JP | 2001-169977 | 6/2001 |
| JP | 2001-169982 | 6/2001 |
| JP | 2001-198060 | 7/2001 |
| JP | 2001-224535 | 8/2001 |
| JP | 2001-231723 | 8/2001 |
| JP | 2001-321310 | 11/2001 |
| JP | 2003-153833 | 5/2003 |
| JP | 2005-46235 | 2/2005 |
| JP | 2008-132210 | 6/2008 |
| JP | 2008-132211 | 6/2008 |
| JP | 2009-543626 | 12/2009 |
| JP | 2010-22855 | 2/2010 |
| JP | 2010-94246 | 4/2010 |
| JP | 2010-284529 | 12/2010 |
| JP | 2011-19915 | 2/2011 |
| JP | 2012-179356 | 9/2012 |
| WO | WO-02/071911 | 9/2002 |
| WO | WO-2007/033915 | 3/2007 |
| WO | WO-2008/009583 | 1/2008 |
| WO | WO-2013/121702 | 8/2013 |
| WO | 2014/117885 | 8/2014 |

OTHER PUBLICATIONS

Search Report dated Apr. 28, 2015 directed towards GB Application No. 1421418.3; 2 pages.

* cited by examiner

FLOOR TOOL FOR A VACUUM CLEANER

REFERENCE TO RELATED APPLICATION

This application claims priority of United Kingdom Application No. 1421418.3, filed on Dec. 2, 2014, the entire contents of which are incorporated herein by reference.

FIELD OF THE INVENTION

The present invention relates to a floor tool for a vacuum cleaner.

BACKGROUND OF THE INVENTION

Vacuum cleaners may include a wand connectable to a variety of accessories. One such accessory is a floor tool which is manoeuvrable over a floor surface to be cleaned. The floor tool may comprise a cleaner head having a suction inlet through which dirt-laden fluid is drawn, and a duct assembly for carrying the dirt-laden fluid from the cleaner head to the wand. The duct assembly may comprise one or more conduits and rotatable joints such that, as the floor tool is manoeuvred over the floor surface using the wand, the cleaner head maintains a relatively flat profile with the floor surface.

A problem with conventional floor tools is that the push force required to manoeuvre the floor tool forwards can be excessive.

SUMMARY OF THE INVENTION

The present invention provides a floor tool for a vacuum cleaner, the floor tool comprising a cleaner head having an inlet through which dirt-laden fluid is drawn into the cleaner head, and an outlet through which the fluid is discharged, and a duct assembly for carrying the fluid from the outlet to a wand connectable to the duct assembly, wherein the duct assembly comprises a front conduit and a rear conduit, the front conduit is connected to the cleaner head for rotation about a first axis, the rear conduit is connectable to the wand, the rear conduit is rotatable relative to the front conduit about a second axis perpendicular to the first axis, and rotation of the rear conduit causes the rear conduit to move within or about the front conduit, and wherein, when the floor tool is resting on the floor and the rear conduit extends upwardly, the front and rear conduits arc around and over the second axis.

The manoeuvrability of the floor tool is improved by reducing the downward force acting on the cleaner head of the floor tool as a result of providing conduits that arc around and over the second axis.

Part of the reduction in downward force on the floor tool is attained from the suction generated within the front and rear conduits during use of the vacuum cleaner. The reduction in pressure within the front and rear conduits causes the conduits to contract slightly. This slight contraction of the conduits causes the cleaner head to lift slightly from the floor surface because the front and rear conduits arc over the second axis. As a result, the force required to push the floor tool decreases, thereby improving the manoeuvrability of the floor tool.

The downward force acting on the floor tool is reduced further by the position of the second axis relative to the front and rear conduits. The front and rear conduits arc over and around, instead of under and around, the second axis. As a consequence, the second axis can be situated at a lower position relative to the cleaner head. When the user attempts to push the floor tool forward using a wand, the force applied to the wand is transferred from the rear conduit to the front conduit at the second axis. The force may be resolved into a vertical component and a horizontal component. Fundamentally, the horizontal component causes the floor tool to move in a forward direction. However, depending on the height of the second axis relative to the cleaner head, the horizontal component may cause the cleaner head to pivot about the second axis. In particular, if the second axis is relatively high, the horizontal component will cause the cleaner head to pivot downwards, thereby increasing the push force necessary to manoeuvre the floor tool. By arcing the front and rear conduits over and around the second axis, the vertical position of the second axis is lowered relative to the cleaner head. As a result, pivoting of the cleaner head in a downward direction may be avoided or significantly reduced, thereby leading to a more manoeuvrable floor tool.

It is understood that a good contact between the floor tool and the surface to be cleaned is desirable to achieve a good overall cleaning efficiency. The cleaning efficiency of the floor tool can decrease if the floor tool is not held against the surface to be cleaned with enough downward force. An additional drawback from using front and rear conduits that arc around and over the second axis is that the path of the fluid flow drawn through the duct assembly is not a straight. Instead, the fluid flow is forced to turn and change direction a number of times as the fluid is carried through the duct assembly. As a result, the velocity of the fluid flow through the duct assembly may decrease, leading to a potential decrease in cleaning efficiency. A beneficial trade-off between cleaning efficiency and manoeuvrability however has been achieved by the floor tool of the present invention.

The floor tool may further comprise two wheels that are located on either side of the front and rear conduits. Providing wheels either side of the front and rear conduits improves the steering and the balance of the floor tool. The wheels may provide a point of contact between the floor tool and the surface to be cleaned. The wheels may be positioned directly beneath the second axis so as to oppose the vertical component of the push force.

The wheels may be inclined and may converge beneath the front and rear conduits. In converging beneath the conduits, the wheels are arranged to rotate about axes such that the separation between the wheels is smallest beneath the conduits. In providing convergent wheels, a space is defined between the two wheels through which the conduits can pass. Accordingly, the floor tool is supported by wheels that do not unduly increase the size, and in particular the height, of the floor tool.

The wheels may be domed shaped. Accordingly, as the front conduit rotates relative to the cleaner head about the first axis, the wheels continue to provide a rolling support. The wheels may provide a substantially continuous arcuate support in the plane normal to the first axis. Consequently, as the floor tool is steered in different directions, a smooth transition occurs as support moves from one wheel to the next.

The surfaces of the wheels may be coincident with a common sphere. Moreover, the centre of the common sphere may be coincident with the first axis. Consequently, as the front conduit rotates relative to the cleaner head, the front conduit maintains the same height above the cleaning surface. This then helps prevent unnecessary lifting of the cleaner head as the floor tool is steered in different directions.

The duct assembly may further comprise a chassis. The two wheels can be fixed to the chassis and the chassis may be connected to and rotatable with the front conduit.

The rear conduit may be moveable about the front conduit. In other words, the front conduit may slide inside the rear conduit. This particular arrangement has the advantage that, during use, fluid is carried through the duct assembly from the smaller cross-section of the front conduit to the larger cross section of the rear conduit. This results in a less restricted fluid flow through the duct assembly. In addition, trapping of dirt and debris in the duct assembly is avoided as the end of the rear conduit does not project or present a shoulder that would protrude into the fluid flow path if the rear conduit were to move within the front conduit.

The floor tool may be configured such that the rear conduit is rotatable between an upper position and lower position, rotation of the rear conduit causes the rear conduit to move about the front conduit, and a greater proportion of the front conduit is surrounded by the rear conduit when the rear conduit is in the upper position.

The outlet of the cleaner head may lie in a plane, the first axis is normal to the plane. Moreover, when the floor tool is resting on the floor, the plane may be substantially vertical to the floor.

The front and rear conduits may together form three bends such that dirt-laden fluid carried through the duct assembly is caused to turn through three bends. On leaving the cleaner head, the dirt-laden fluid may initially turn upwardly, and then downwardly over and around the second axis. Thereafter the fluid may turn again upwardly as it is carried through the duct assembly with the rear conduit extending upwardly.

The present invention also provides a floor tool for a cleaning appliance, the floor tool comprising a cleaner head having an inlet through which dirt-laden fluid is drawn into the cleaner head and an outlet through which the fluid is discharged, and a duct assembly for carrying the fluid from the cleaner head to a wand connectable to the duct assembly, wherein the duct assembly comprises a front conduit, a rear conduit and two wheels located on either side of the front and rear conduits, the front conduit is connected to the cleaner head for rotation about a first axis, the first axis is normal to the plane of the outlet, the rear conduit is connectable to the wand, the rear conduit is rotatable relative to the front conduit about a second axis perpendicular to the first axis, and rotation of the rear conduit causes the rear conduit to move within or about the front conduit, wherein rotation of the rear conduit about the second axis causes the rear conduit to move up and down between an upper and a lower position, and rotation of the front conduit about the first axis causes the rear conduit in the upper position to move to the right and left, and wherein, when the floor tool is resting on the floor and the rear conduit is in the upper position, the front and rear conduits arc around and over the second axis.

The present invention further provides a vacuum cleaner comprising a wand connected to a floor tool as claimed in any previous claim, wherein movement of the wand in an up and down motion causes the rear conduit to move up and down, and twisting of the wand to the right and left causes the front conduit to rotate about the first axis such that, when the rear conduit is in the upper position, the rear conduit is caused to move to the right and left.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
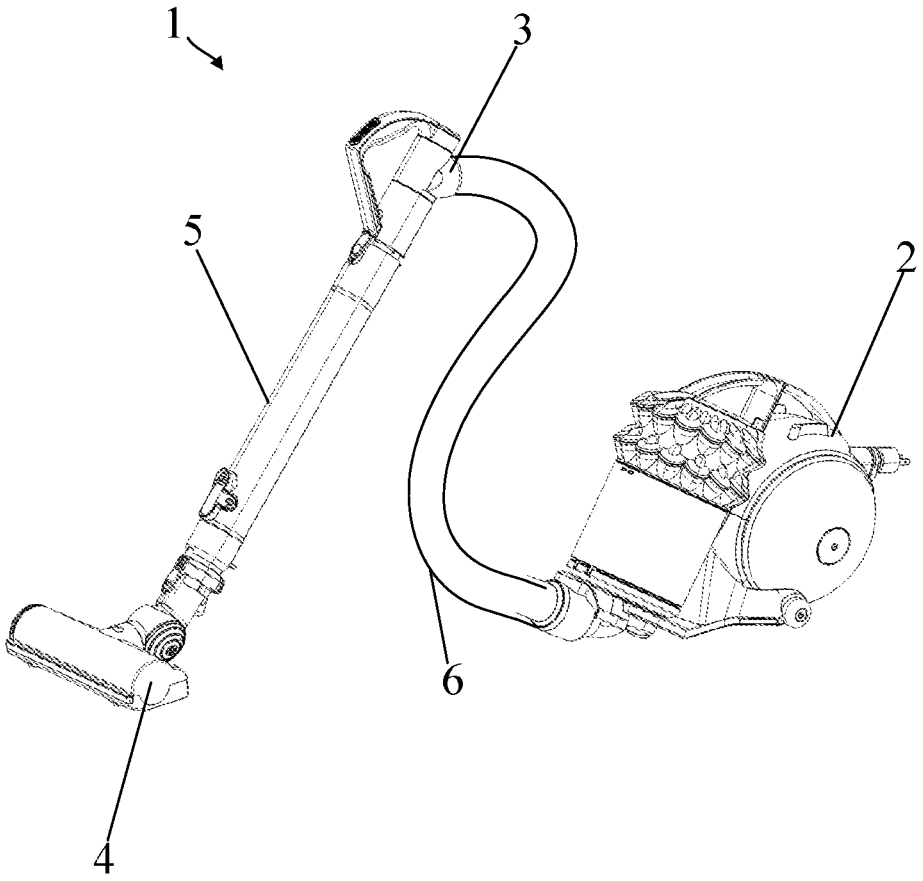
FIG. 1 is a schematic of a vacuum cleaner.
Figure 2:
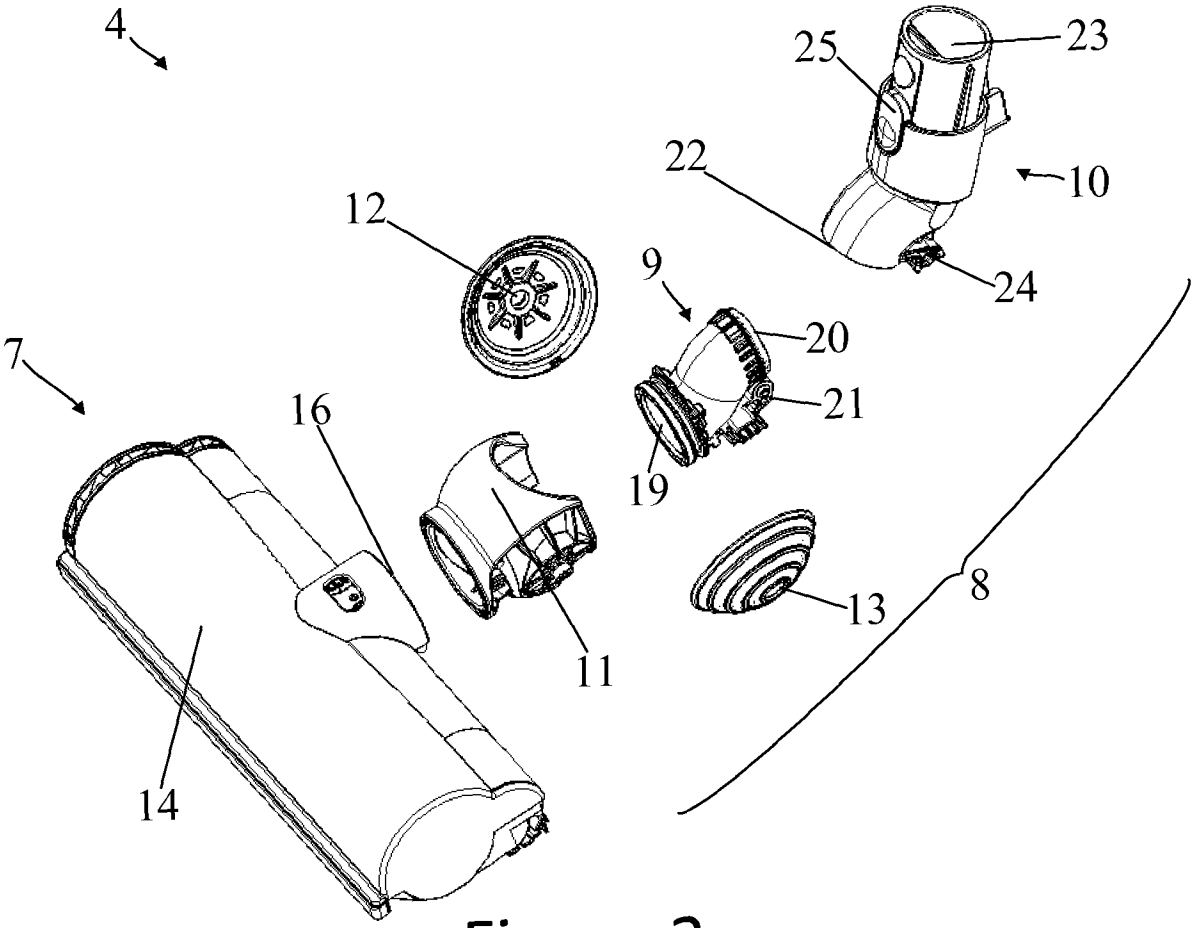
FIG. 2 is an exploded view of a cleaner head.
Figure 3:
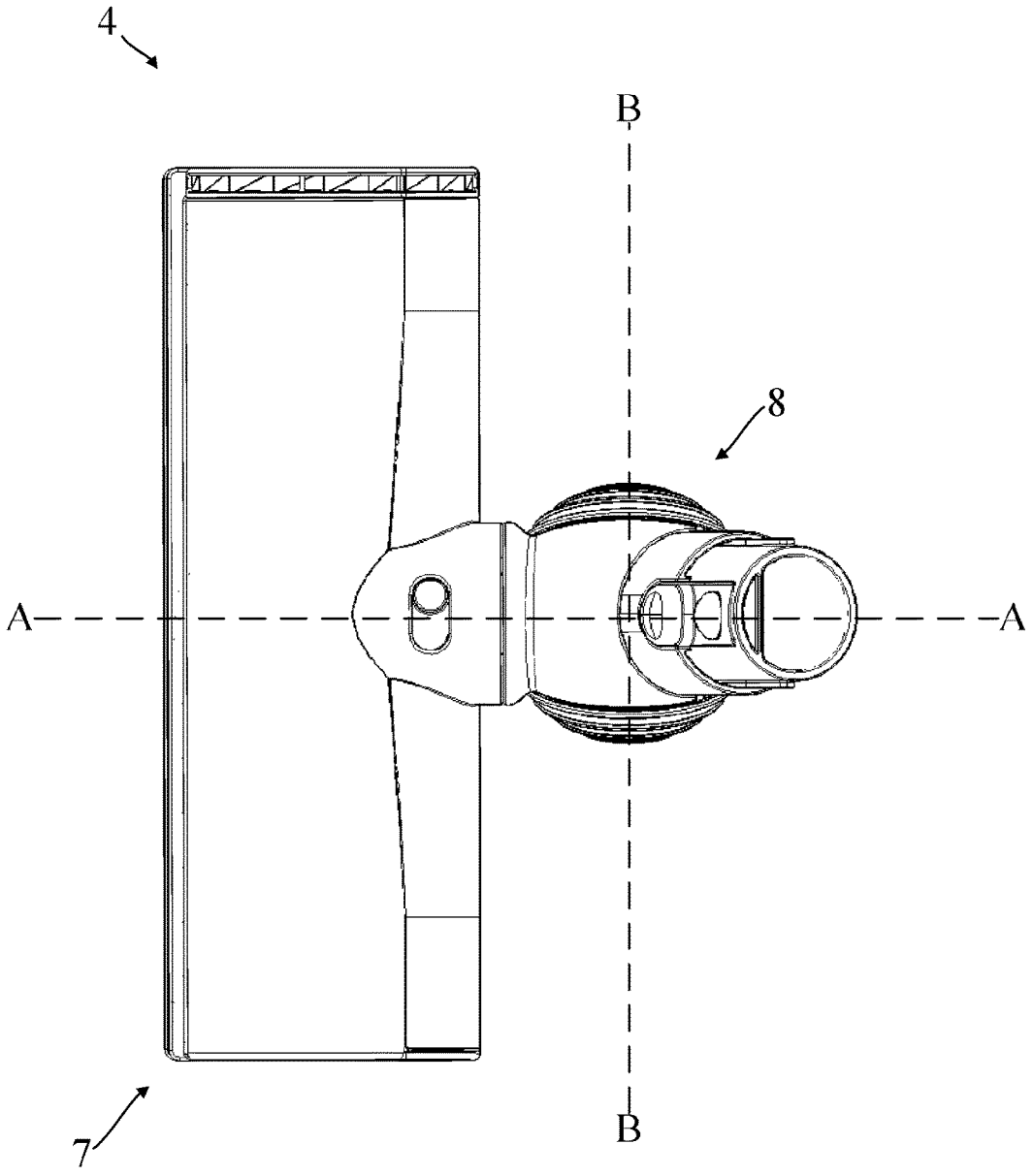
FIG. 3 is a top view of a cleaner head, with the rear conduit of the cleaner head in an upper position.

FIG. 1 illustrates a vacuum cleaner 1 comprising a main body 2, a wand assembly 3, and a floor tool 4. The main body 2 is connected to the wand assembly 3, and the wand assembly 3 is connected to the floor tool 4.

The wand assembly 3 comprises a hose 6 and a wand 5 for fluidly connecting together the floor tool 4 and the vacuum cleaner 2.

The floor tool 4 is shown in more detail in FIGS. 2 to 5. The floor tool 4 comprises a cleaner head 7, and a duct assembly 8.

The cleaner head 7 comprises a housing 14, an inlet 15, an outlet 16 and a brush bar 17. The housing 14 defines a chamber 18 within which the brush bar 17 is rotatably mounted. The inlet 15 is formed on the underside of the housing 14 and an outlet 16 is provided to the rear of the housing 14.

The duct assembly 8 comprises a front conduit 9, a rear conduit 10, a chassis 11 and two wheels 12,13.

The front conduit 9 comprises an inlet 19, an outlet 20 and a pivot bracket 21. The front conduit 9 is rotatably attached to the cleaner head 7. The outlet 16 of the cleaner head 7 connects to the inlet 19 of the front conduit 9 to provide a fluid flow path. The front conduit 9 is free to rotate about first axis A-A, shown in FIG. 3. The front conduit 9 is provided with a gasket or annular seal 26 formed around the inlet 19. The annular seal 26 forms a compression seal between the outlet 16 of the cleaner head 7 and the inlet 19 of the front conduit 9 to avoid air leakages in the floor tool 4.

The rear conduit 10 comprises an inlet 22, an outlet 23 and a pivot bracket 24. The rear conduit 10 also has a rearward connection part 25 for connection to the wand assembly 3. The rear conduit 10 is pivotally or rotatably connected to the front conduit 9. The pivot bracket 24 of the rear conduit 10 is mounted onto the pivot bracket 21 of the front conduit 9 and secured by screws (not shown). The pivot brackets 21,24 allow for the rear conduit 10 to rotate about a second axis, shown as B-B in FIG. 3. The rear conduit 10 surrounds the front conduit 9 such that the front conduit 9 slides in and out of the rear conduit 10 as the rear conduit 10 rotates about the about the second axis B-B. An annular lip seal 27 is provided around the outlet 20 of the front conduit 9. The annular lip seal 27 contacts the rear conduit 10 and provides a seal between the front conduit 9 and rear conduit 10 to avoid air leakages in the floor tool 4.

Figure 4:
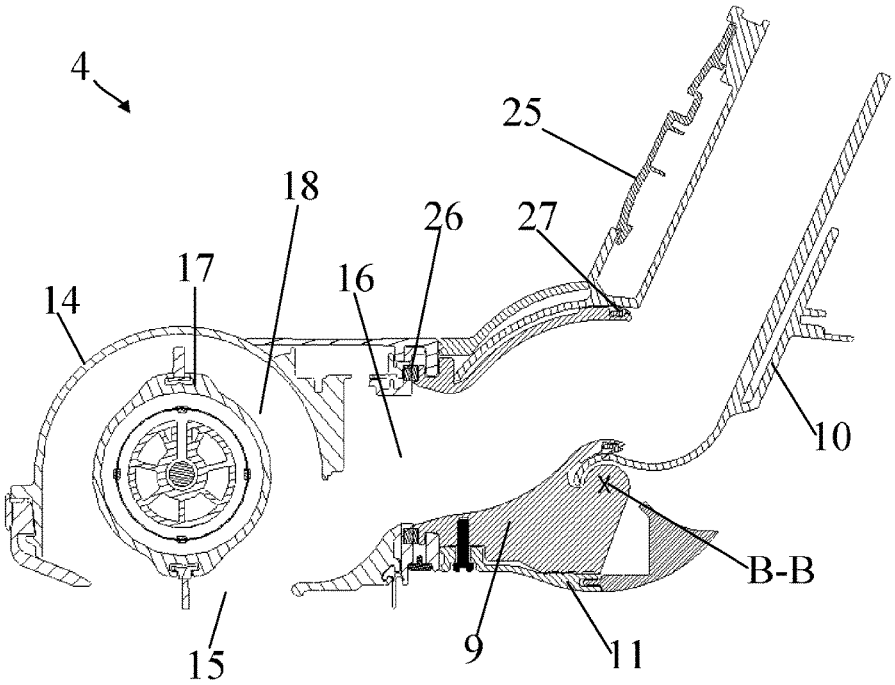
FIG. 4 is a side sectional view of the cleaner head along line A-A in FIG. 3, with the rear conduit in an upper position.
Figure 5:
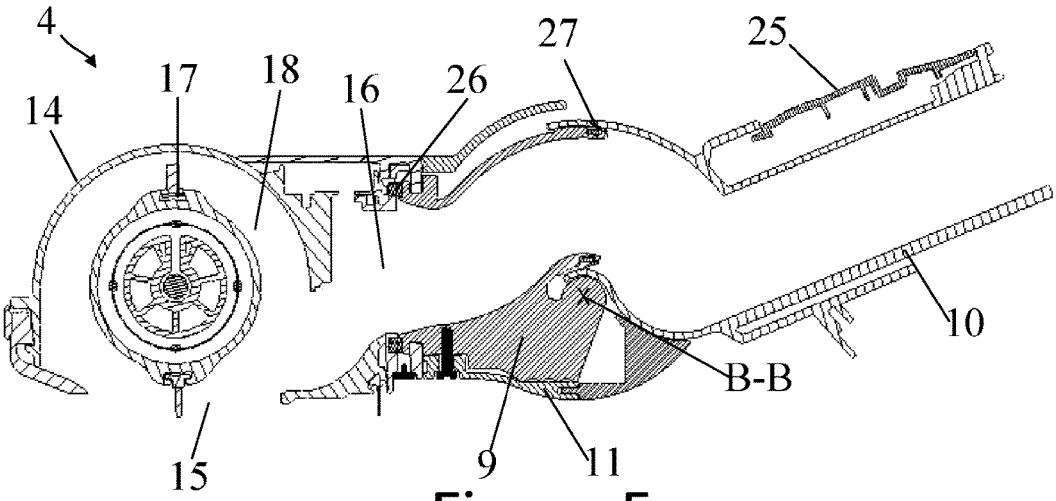
FIG. 5 is a side sectional view of the cleaner head along line A-A in FIG. 3, with the rear conduit in a lower position.

Rotation of the rear conduit 10 about the second axis B-B causes the rear conduit 10 to move between an upper position (FIG. 4) and a lower position (FIG. 5). In the upper position, the rear conduit 10 surrounds more of the front conduit 9. In the lower position, the rear conduit 10 surrounds less of the front conduit 9. Moving the rear conduit 10 from the upper position to the lower position lengthens the fluid flow path through the duct assembly 8. Conversely, moving the rear conduit 10 from the lower position to the upper position shortens the fluid flow path through the duct assembly 8.

As can be seen in FIGS. 4 and 5, the front conduit 9 and the rear conduit 10 arc around and over the second axis B-B. The fluid flow path through the front conduit 9 and rear conduit 10 is thereby convoluted with three bends. The dirt-laden fluid is forced to turn upwardly as it enters the front conduit 9 and subsequently turn downwardly as the dirt-laden fluid passes from the front conduit 9 to the rear conduit 10. The dirt-laden fluid is then forced again to turn upwardly travelling through the rear conduit 10 towards the wand 5.

The chassis 11 is attached to the front conduit 9 and is rotatable with the front conduit 9 about the first axis A-A.

The wheels 12,13 are mounted on the chassis 11. Each wheel 12,13 is domed-shaped and is rotatably attached to the chassis 11. One wheel 12 rotates about a first axis of rotation and the other wheel 13 rotates about a second axis of rotation. The axes of rotation are non-parallel and lie in a common plane. The wheels 12,13 are tilted against the chassis 11 and converge beneath the front conduit 9 and rear conduit 10, i.e. the separation between the wheels 12,13 is smallest beneath conduits 9,10. In providing convergent wheels 12,13, a space is defined between the two wheels 12,13 through which the front conduit 9 and rear conduit 10 can pass.

The chassis 11 and the wheels 12,13 provide support for the floor tool 4 on the surface to be cleaned. The point of contact between the wheels 12,13 and the surface to be cleaned is beneath the front conduit 9 and rear conduit 10.

The curvature of each dome-shaped wheel 12,13 is spherical. Furthermore, the two wheels 12,13 are arranged (i.e. spaced from one another and tilted) such that the surfaces of the wheels 12,13 are coincident with a common sphere. The surfaces of the two wheels 12,13 may thus be regarded as defined by an imaginary sphere. Consequently, as the front conduit 9 rotates about the first axis A-A, the wheels 12,13 continue to support the front conduit 9 at the same height above the cleaning surface. No lifting of the cleaner head 7 therefore occurs and a flat profile with the cleaning surface is maintained.

In use, the floor tool 4 is manoeuvred by the user using the wand 5. The cleaner head 7 maintains a relatively flat profile with the floor surface as the floor tool 4 is manoeuvred by the user. The user can move the floor tool 4 forwards and backwards by pushing or pulling on the wand 5. The change in angle of the wand 5 relative to the floor surface is accounted for by movement of the rear conduit 10 about the second axis B-B. The user can also steer the floor tool 4 left and right by twisting the wand 5 accordingly. The twisting action through the wand 5 causes the front conduit 9 to rotate about the first axis A-A. The floor tool 4 is thereby guided by the push/pull and twisting force delivered through the wand 5 by the user.

As the floor tool 4 is manoeuvred by the user, the wheels 12,13 rotate to provide rolling support. As the left or right motions of wand 5 are conveyed through to the cleaner head, the front conduit 9 and chassis 11 rotate, to an extent that at least one of the wheels 12,13 maintains contact with the floor to provide rolling support.

In contrast to conventional floor tools which have conduits which arc under a pivot axis, it has been found that improved manoeuvrability of the floor tool 4 can be achieved by arcing the front conduit 9 and the rear conduit 10 around and over the second axis B-B.

During use, a partial vacuum is created in the duct assembly 8. The partial vacuum reduces the pressure within the front conduit 9 and the rear conduit 10. The rear conduit 10 is fixed in position by the user holding the wand 5 and the front conduit 9 is free to move within the rear conduit 10. The reduction in pressure urges the front conduit 9 towards the fixed rear conduit 10 so that the conduits 9,10 occupy a smaller volume. The front conduit 9 is arced over and around the second axis B-B, and so movement of the front conduit 9 towards the rear conduit 10 causes the cleaner head 7 to lift slightly from the surface to be cleaned. This slight lifting of the cleaner head 7 reduces the downward force on the floor tool 4 and thereby decreases the push force required to manoeuvre the floor tool 4.

The manoeuvrability of the floor tool 4 is also improved by the height (i.e. the vertical position) of the second axis B-B relative to the cleaner head 7. During use, the push force applied by the user via the wand 5 is transferred to the rear conduit 10. The rear conduit 10 in turn transfers the push force to the front conduit 9 via the pivot brackets 21,24. The force can be resolved into a horizontal component and a vertical component at the second axis B-B. The second axis B-B formed by the pivot brackets 21,24 is positioned below the centre of the connection between the front conduit 9 and the cleaner head 7. As a result, the horizontal component is transferred from the front conduit 9 to the cleaner head 7 at a height that avoids a downward pivoting of the cleaner head 7. Thus the downward force on the floor tool 4 is reduced. In contrast, if the second axis B-B were positioned above the centre of the connection between the front conduit 9 and the cleaner head 7 then the horizontal component would cause the cleaner head 7 to pivot downwards, thereby increasing the downwards force acting on the cleaner head 7.

Although the vacuum cleaner 1 of FIG. 1 is a cylinder or canister type vacuum cleaner, the floor tool 4 might equally be used with other types of vacuum cleaners such as a stick or an upright vacuum cleaner.

In the embodiment shown in Figures, the cleaner head 7 has a brush bar 17. However, the cleaner head 7 may include alternative means for agitating or otherwise working a surface to be cleaned. Alternatively, the brushbar 17 may be omitted altogether from the cleaner head 7.

The invention claimed is:

1. A floor tool for a vacuum cleaner, the floor tool comprising:

a cleaner head having an inlet through which dirt-laden fluid is drawn into the cleaner head, and an outlet through which the fluid is discharged; and a duct assembly configured for connection to a wand and for carrying the fluid from the outlet to the wand, wherein the duct assembly comprises a front conduit and a rear conduit, the front conduit is connected to the cleaner head for rotation about a first axis, the rear conduit is connectable to the wand, the rear conduit is rotatable relative to the front conduit about a second axis perpendicular to the first axis, and rotation of the rear conduit causes the rear conduit to move within or about the front conduit, and wherein, when the floor tool is resting on the floor and the rear conduit extends upwardly, the front and rear conduits are above the second axis and arc around and over the second axis.

2. The floor tool of claim 1, wherein the duct assembly further comprises two wheels that are located on either side of the front and rear conduits.

3. The floor tool of claim 2, wherein the wheels are inclined and converge beneath the front and rear conduits.

4. The floor tool of claim 2, wherein the wheels are dome shaped.

5. The floor tool of claim 1, wherein the wheels have surfaces coincident with a common sphere.

6. The floor tool of claim 1, wherein the duct assembly further comprises a chassis, the two wheels are fixed to the chassis, and the chassis is connected to and rotatable with the front conduit.

7. The floor tool of claim 1, wherein the rear conduit is moveable about the front conduit.

8. The floor tool of claim 7, wherein the rear conduit is rotatable between an upper position and lower position, rotation of the rear conduit causes the rear conduit to move about the front conduit, and a greater proportion of the front conduit is surrounded by the rear conduit when the rear conduit is in the upper position.

9. The floor tool of claim 1, wherein the outlet lies in a plane, and the first axis is normal to the plane.

10. The floor tool of claim 9, wherein when the floor tool is resting on the floor, the plane is substantially vertical to the floor.

11. The floor tool of claim 1, wherein the front and rear conduits together form three bends, such that dirt-laden fluid carried through the duct assembly is caused to turn through three bends.

12. A floor tool for a cleaning appliance, the floor tool comprising:

a cleaner head having an inlet through which dirt-laden fluid is drawn into the cleaner head and an outlet through which the fluid is discharged; and a duct assembly configured for connection to a wand and for carrying the fluid from the cleaner head to the wand;

wherein the duct assembly comprises a front conduit, a rear conduit and two wheels located on either side of the front and rear conduits;

the front conduit is connected to the cleaner head for rotation about a first axis, the first axis is normal to the plane of the outlet, the rear conduit is connectable to the wand, the rear conduit is rotatable relative to the front conduit about a second axis perpendicular to the first axis, and rotation of the rear conduit causes the rear conduit to move within or about the front conduit, wherein rotation of the rear conduit about the second axis causes the rear conduit to move up and down between an upper and a lower position, and rotation of the front conduit about the first axis causes the rear conduit in the upper position to move to the right and left; and wherein, when the floor tool is resting on the floor and the rear conduit is in the upper position, the front and rear conduits are above the second axis and arc around and over the second axis.

13. The floor tool of claim 12, wherein the wheels are inclined and converge beneath the front and rear conduits.

14. The floor tool of claim 13, wherein the wheels have surfaces coincident with a common sphere.

15. The floor tool of claim 12, wherein rotation of the rear conduit causes the rear conduit to move about the front conduit, and a greater proportion of the front conduit is surrounded by the rear conduit when the rear conduit is in the upper position.

16. The floor tool of claim 12, wherein the front and rear conduits together form three bends such that dirt-laden fluid carried through the duct assembly is caused to turn through three bends.

17. A vacuum cleaner comprising a wand connected to a floor tool, the floor tool comprising:

a cleaner head having an inlet through which dirt-laden fluid is drawn into the cleaner head, and an outlet through which the fluid is discharged; and a duct assembly configured for connection to the wand and for carrying the fluid from the outlet to the wand, wherein the duct assembly comprises a front conduit and a rear conduit, the front conduit is connected to the cleaner head for rotation about a first axis, the rear conduit is connectable to the wand, the rear conduit is rotatable relative to the front conduit about a second axis perpendicular to the first axis, and rotation of the rear conduit causes the rear conduit to move within or about the front conduit, and wherein, when the floor tool is resting on the floor and the rear conduit extends upwardly, the front and rear conduits are above the second axis and arc around and over the second axis, wherein movement of the wand in an up and down motion causes the rear conduit to move up and down, and twisting of the wand to the right and left causes the front conduit to rotate about the first axis such that, when the rear conduit is in the upper position, the rear conduit is caused to move to the right and left.

18. A vacuum cleaner comprising a wand connected to a floor tool, the floor tool comprising:

a cleaner head having an inlet through which dirt-laden fluid is drawn into the cleaner head and an outlet through which the fluid is discharged; and a duct assembly configured for connection to the wand and for carrying the fluid from the cleaner head to the wand;

wherein the duct assembly comprises a front conduit, a rear conduit and two wheels located on either side of the front and rear conduits;

the front conduit is connected to the cleaner head for rotation about a first axis, the first axis is normal to the plane of the outlet, the rear conduit is connectable to the wand, the rear conduit is rotatable relative to the front conduit about a second axis perpendicular to the first axis, and rotation of the rear conduit causes the rear conduit to move within or about the front conduit, wherein rotation of the rear conduit about the second axis causes the rear conduit to move up and down between an upper and a lower position, and rotation of the front conduit about the first axis causes the rear conduit in the upper position to move to the right and left; and wherein, when the floor tool is resting on the floor and the rear conduit is in the upper position, the front and rear conduits are above the second axis and arc around and over the second axis, wherein movement of the wand in an up and down motion causes the rear conduit to move up and down, and twisting of the wand to the right and left causes the front conduit to rotate about the first axis such that, when the rear conduit is in the upper position, the rear conduit is caused to move to the right and left.

* * * * *